United States Patent [19]

Bartley

[11] 4,165,590

[45] Aug. 28, 1979

[54] INDUSTRIAL BUILDING STRUCTURE AND METHOD OF ERECTION

[75] Inventor: Thomas S. Bartley, Mobile, Ala.

[73] Assignee: International Paper Company, New York, N.Y.

[21] Appl. No.: 804,243

[22] Filed: Jun. 7, 1977

[51] Int. Cl.[2] ..... E04B 1/346

[52] U.S. Cl. ..... 52/66; 52/69

[58] Field of Search ..... 52/66, 69, 64, 3, 18

[56] References Cited

U.S. PATENT DOCUMENTS

| | | | |
|---|---|---|---|
| 730,275 | 6/1903 | Laswell | 52/66 |
| 2,586,934 | 2/1952 | Gerber | 52/18 |
| 2,825,430 | 3/1958 | Hooper | 52/64 |
| 3,283,923 | 11/1966 | Schnyder | 52/66 |

FOREIGN PATENT DOCUMENTS

| | | | |
|---|---|---|---|
| 265549 | 10/1913 | Fed. Rep. of Germany | 52/64 |
| 872995 | 4/1953 | Fed. Rep. of Germany | 52/64 |

*Primary Examiner*—James A. Leppink
*Assistant Examiner*—Henry E. Raduazo
*Attorney, Agent, or Firm*—Finnegan, Henderson, Farabow & Garrett

[57] ABSTRACT

An improved industrial building structure for housing the dryer section of a paper-making machine where a building substructure transfers the substantial part of the weight of a building superstructure and roof to the opposed, weight-bearing sides of the dryer frame. Edge-abutted roof sections completely spanning the dryer frame and individually rotatable about edge-mounted hinges allow access to the top of the dryer for maintenance. Operating and maintenance spaces at the sides of the dryer are defined and enclosed by the substructure.

11 Claims, 3 Drawing Figures

INDUSTRIAL BUILDING STRUCTURE AND METHOD OF ERECTION

BACKGROUND OF THE INVENTION

1. Field of the Invention

This invention relates to building structures for housing machines used in industrial manufacture. In particular, the present invention relates to improvements in the industrial building structure system disclosed in my U.S. Pat. No. 3,961,712 for housing machinery, e.g., a paper machine, for use in a continuous process activity.

2. Description of the Prior Art

As was more fully described in my U.S. Pat. No. 3,961,712, industrial buildings for continuous process activity such as the manufacture of kraft paper, traditionally were constructed much larger than necessary to house the particular machinery itself. The oversized building dimensions were required to enclose a traveling crane and hoist system used to service the particular machine, such as replacing one of the paper dryers in a paper machine. These paper dryers can be 35 feet long, 6 feet in diameter and weigh over 50,000 pounds.

Newer industrial building concepts, such as disclosed in my earlier U.S. patent, involve tailoring the size of different sections of the building to accommodate the machinery of that section. In particular, for the dryer section of a paper-making machine, it is possible to significantly reduce the size of the enclosing building structure by eliminating the enclosed traveling crane system. Thus, the use of an external crane system, such as shown in my previous patent, allowed the size of the building enclosing the dryer section to be markedly reduced resulting in a building with a lower initial cost, with attendant savings in the usual operating costs, such as heating, lighting and maintenance.

The ability to reduce the size of the dryer section building is nevertheless limited by the need for enclosed areas along both sides of the machine to house the paper dryer drive motors, bearing lubrication apparatus, and associated equipment. These enclosed side areas are also used for the replacement of the felt rolls and general maintenance on the machine itself. The size of the felt rolls makes it imperative that sufficient space exists in at least one of the side areas for the passage of small material handling vehicles. Also, the side area is needed to remove torn paper from the dryer. This operation, called "spearing," is traditionally done by hand and requires the use of a long hooked probe operated by several men.

The width of modern paper making machines can exceed 35 feet in the dryer section, and the width of the building to accommodate the machine and side working areas can often exceed 90 feet. The difficulty and expense of erecting a structure to span the entire building width unsupported except at the sides has necessitated the utilization of intermediate support columns in the prior art structures. These intermediate support columns traditionally were placed immediately adjacent to the paper machine frame to minimize the length of the unsupported roof section. The placement of the columns closely adjacent to the machine frame often required the use of elaborate duct work to bypass the supports and complex coupling apparatus to connect the paper dryers with the drive motors. These drive motors were also located adjacent to the frame but had to be offset to clear the support columns.

Although the reduced size of the dryer building shown in U.S. Pat. No. 3,961,712 allows the use of a removable roof section to allow replacement of the cylindrical paper dryers from the top of the machine, the absolute size of these roof sections makes them extremely difficult to control when suspended by a crane mechanism except when the operation is carried out in an enclosed or semi-enclosed environment. These roof sections are typically made as light as possible, inasmuch as their weight governs the size of the supporting building frame structural members and thus the overall cost of the building section. The light weight of the sections coupled with the large surface area contributes to a sail-like effect even in light wind conditions, thereby complicating, and introducing a degree of danger to, the paper dryer removal operation.

SUMMARY OF THE INVENTION

The present invention overcomes the problems of the prior art industrial building systems by providing a building structure wherein the intermediate support columns for the roof section are eliminated and the vertical forces are taken up by the machine frame itself and also by providing roof sections that can be folded back to expose the top of the dryer machine without the necessity for completely removing the sections. The improvements in the building structure significantly enhance the benefits to be derived from the tailored building concept and improve the overall efficiency of the maintenance operations carried out on the dryer machinery.

In accordance with the industrial building structure invention, as embodied and broadly described herein, the industrial building structure of this invention for housing a machine with an anchored frame and at least two opposed, weight-bearing sides comprises enclosure means for the top of the machine, the top enclosure means including roof means for protecting the machine top from the weather and a building frame superstructure for supporting the roof means, the roof means including means for providing access to substantially the entire machine top area bounded by the two machine frame sides, the accessing means permitting maintenance on the machine through the roof means; and means providing for support by the machine frame sides of a substantial part of the weight of the top enclosure means.

Preferably, whenever the machine requires operating and maintenance space at the sides of the machine, the support means includes a building frame substructure for transmitting the substantial part of the weight of the top enclosure means to the weight-bearing sides and for enclosing each of the two machine frame sides along with the operating and maintenance space associated with each side.

It is also preferred that the building frame substructure include a plurality of vertical members spaced along and parallel to the machine frame sides and set out from the sides predetermined distances; and a plurality of transverse members extending from the vertical members to the machine frame sides, the transverse members being fixedly attached to the vertical members and to the machine frame sides, and being supported in the vertical direction in part by the machine frame sides and in the other part by the vertical members, the top enclosure means being supported by the substructure at points closely adjacent to the machine frame sides whereby the substantial part of the weight of the top enclosure means is distributed to the machine frame sides, and the substructure defining the associated operating and maintenance space for the machine and providing framework for sealing off the space and the sides of the machine from the weather.

It is also preferred that the building frame superstructure include a plurality of superstructure vertical members for distributing the weight of the roof means to the top enclosure support means, the superstructure vertical members extending above the highest part of the machine frame and positioned outside of, and closely adjacent to, the machine frame sides; and at least two superstructure longitudinal members connecting each of the superstructure vertical members on the respective sides of the machine frame, the superstructure longitudinal members being positioned at the upper ends of the superstructure vertical members.

It is also preferred that the roof means includes a plurality of edge-abutted roof sections each extending between the pair of superstructure longitudinal support members and spanning the machine and being removably attached to both immediately adjacent sections and to the superstructure longitudinal support members, each section being rotatable about 180° on at least one of a pair of axes lying along the respective abutted edges, wherein said sections are attached to the adjacent sections by pluralities of pairs of hinge assemblies having removable pins, the pins of each of the pairs of hinge assemblies lying on the respective one of the axes of rotation, and wherein the sections are attached to the superstructure longitudinal support members by a plurality of removable bolt means, and each of the sections being substantially rigid for minimizing deformation during rotation, the section when rotated being supported solely by the respective one of the adjacent sections.

Further in accordance with the invention, as embodied and broadly described herein, the method for erecting a building to enclose from the weather a space for housing a large machine and associated operating and maintenance areas, the machine having a frame to be anchored to a foundation, and the frame having weight-bearing members with excess capacity, comprises installing temporary vertical supports prior to the assembly of the machine frame in the space to be occupied by the assembled machine, the temporary supports being adjacent the space to be occupied by the machine and extending to the top level of the machine frame member having excess weight-bearing capacity; erecting and covering the frame of the building to house the machine, the temporary vertical supports being used to bear part of the weight of the covered building frame, the part being less than the excess capacity of the machine frame; assembling the machine frame within the space enclosed by the covered building frame, the machine frame being protected from the weather during the assembling procedure by the covered building frame; transferring the part of the covered building frame weight from the temporary vertical supports to the machine frame; and removing the temporary vertical supports and assembling the rest of the machine.

The accompanying drawing, which is incorporated in and constitutes a part of the specification, illustrates one embodiment of the invention and, together with the description, serves to explain the principles of the invention.

DESCRIPTION OF THE PREFERRED EMBODIMENT

Reference will now be made in detail to the present preferred embodiment of the invention, an example of which is illustrated in the accompanying drawing.

Figure 1:
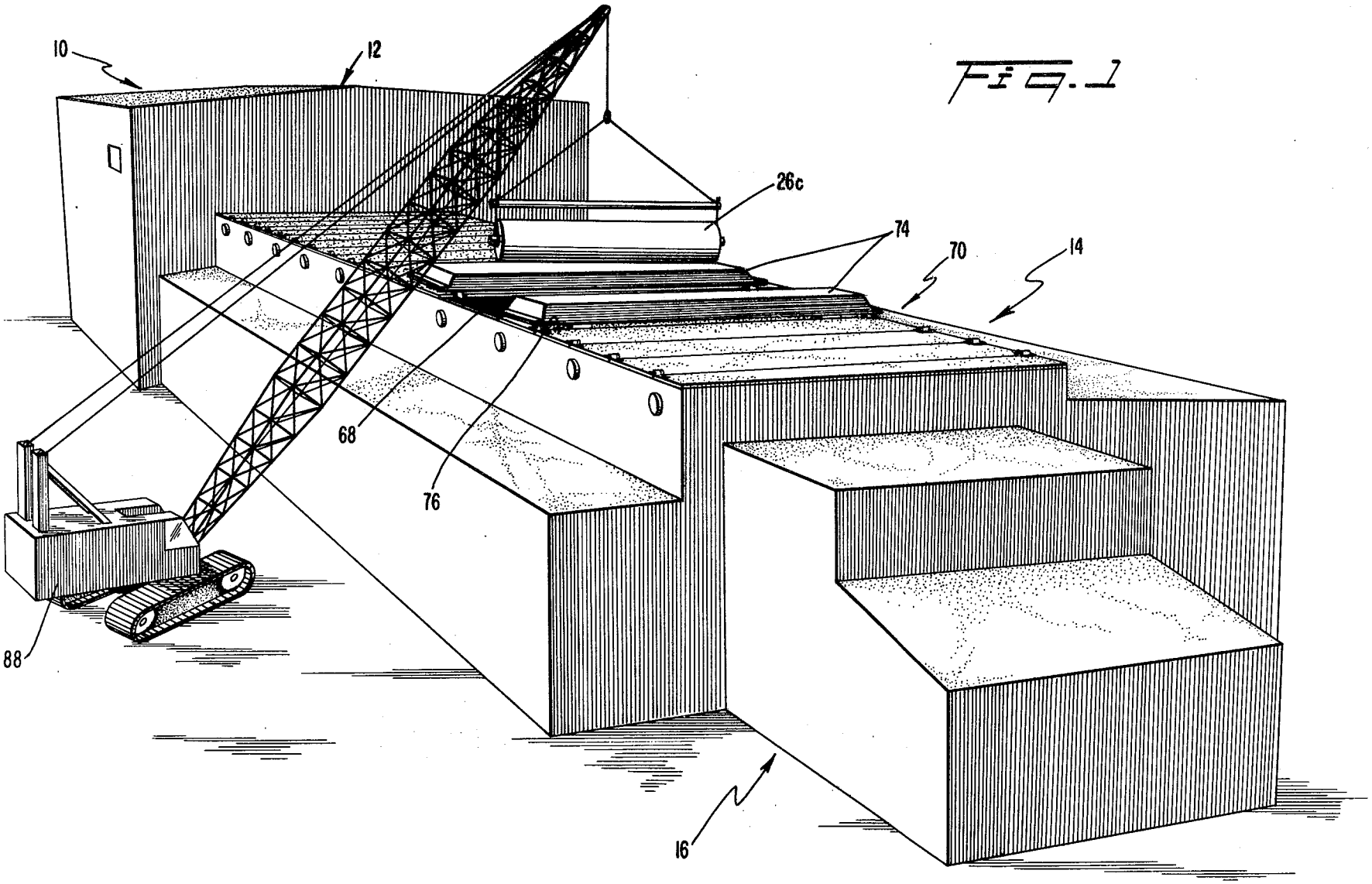
FIG. 1 is an isometric view of an industrial building structure system in accordance with this invention and illustrated with respect to housing paper producing and processing machinery.

Referring now to FIG. 1, there is shown building 10 which is constructed according to this invention and which is shown as adapted to enclose machinery for making paper. Building 10, as illustrated herein, is sectionalized to accommodate different parts of the paper making machinery and process. Section 12 houses the paper-forming components of the machine, including the head box, the fourdrinier apparatus, and press sections. Section 14 houses the paper drying apparatus including the breaker stacks and the calender components. Section 16 is the winder section and includes ramp facilities for removal of the completed rolls of paper and also facilities for loading the rolls for transportation by truck or railroad. A conventional warehouse structure (not shown) may be used in conjunction with building 10 and would be conveniently situated in series with winder section 16.

The present invention is shown and described as housing a paper making machine, and specifically the dryer section. The scope of the invention, however, is not considered to be limited to this application since the invention can be adapted and utilized in conjunction with other large machinery.

Figure 2:
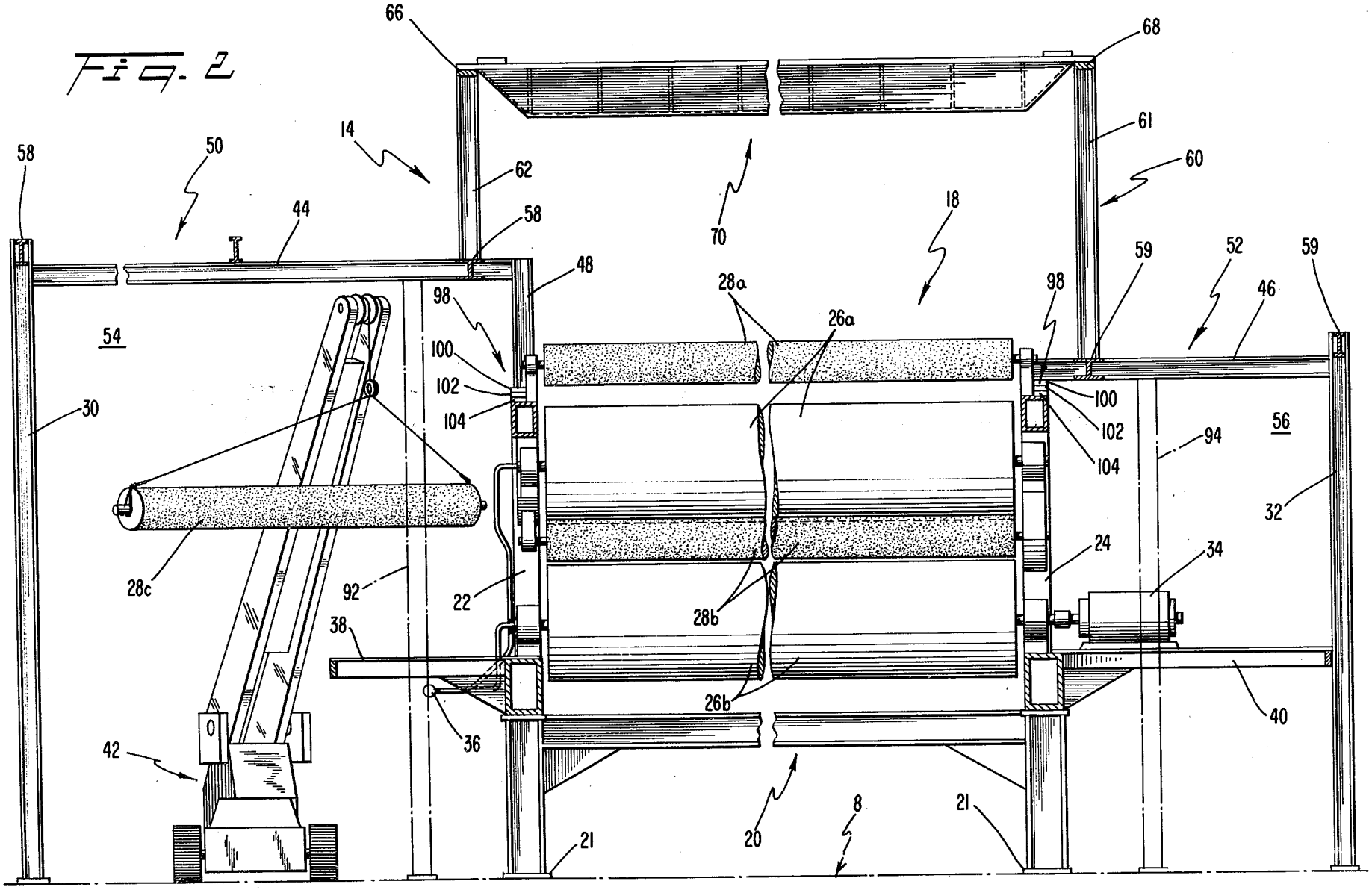
FIG. 2 is a cross-sectional view through the dryer section of the building of FIG. 1.

As best seen in FIG. 2, building section 14 is shown as completely enclosing the drying apparatus 18 of the paper making machine. The drying apparatus 18 consists of a heavy-duty frame 20 having opposed vertical sides 22 and 24 for supporting the cylindrical paper dryers, such as dryers **26*a* and 26*b*, and the felt rolls, such as rolls 28*a* and 28*b*. As the continuous sheet of paper is carried on the endless felt belt (both not shown) through the machine over the individual paper dryers such as 28*a*, 28*b*, which are heated internally by steam, the excess water is driven from the paper. Frame 20 is usually firmly anchored to a foundation or base flooring 8 by support plates 21** in order to accommodate both the static and dynamic forces developed by the machine.

In accordance with this invention, means are provided for support by machine frame sides 22, 24 of a substantial part of the weight of the top part of building section 14 including superstructure 60 and roof 70 (to be described in greater detail henceforth), which houses dryer apparatus 18. As embodied herein, a building frame substructure 50, 52 is supplied for receiving the weight of the top enclosure and distributing the greater part to frame sides 22, 24. Substructure 50, 52 also acts to define the maintenance spaces required for operating and servicing machine 18 through frame sides 22, 24, respectively 54, 56, and to provide a framework for enclosing these spaces.

It is imperative that the weight-bearing sides of the machine frame have sufficient excess loading capacity to safely support the weight of the apportionate part of the top enclosure. This excess loading capacity is generally available with the massive frames used to support paper making machinery, enabling the frame to replace column supports traditionally positioned directly alongside frame sides 22, 24.

Preferably, substructure 50, 52 includes a series of vertical members 30 and 32 spaced along and parallel to the dryer apparatus and are set out predetermined distances from the machine frame sides 22 and 24 and further includes a series of transverse members 44, 46 attached to and extending from members 30, 32 to the respective machine frame sides. The predetermined set out distances of 30, 32 are sized to accommodate apparatus necessary to support the operation of the dryer machinery, including dryer motor 34 and lubrication system 36. This apparatus is shown mounted on maintenance platforms 38 and 40 which can be supported solely by the machine frame sides, such as is shown in catwalk 38, or can be supported between the machine frame side and the vertical members, such as shown in platform 40.

It is also preferred that the vertical members associated with one or the other of the machine frame sides, such as vertical member 30 in relation to side 22 in FIG. 2, be set out a distance sufficient to enable the removal of the felt rolls **28*a* and 28*b* directly through the machine frame side within the space 54, as is shown in FIG. 2. Ideally, the set-out distance for vertical support member 30 will be sufficient to enable vehicular material moving equipment, such as mobile hoist 42, shown supporting a replacement felt roll 28*c***, to assist in the various maintenance operations.

Each of the series of transverse members 44 and 46 extends from the respective one of the series of vertical members 30 and 32 to the respective machine frame side. The transverse members can be affixed directly to the dryer machine frame, as is shown by transverse member 46, or the transverse member can be attached to the frame by the use of frame extension 48, as shown with transverse member 44 in FIG. 2. The use of frame extension 48 enables the top felt roll **28*a* to be serviced through side 22 of dryer machine frame 20**.

Figure 3:
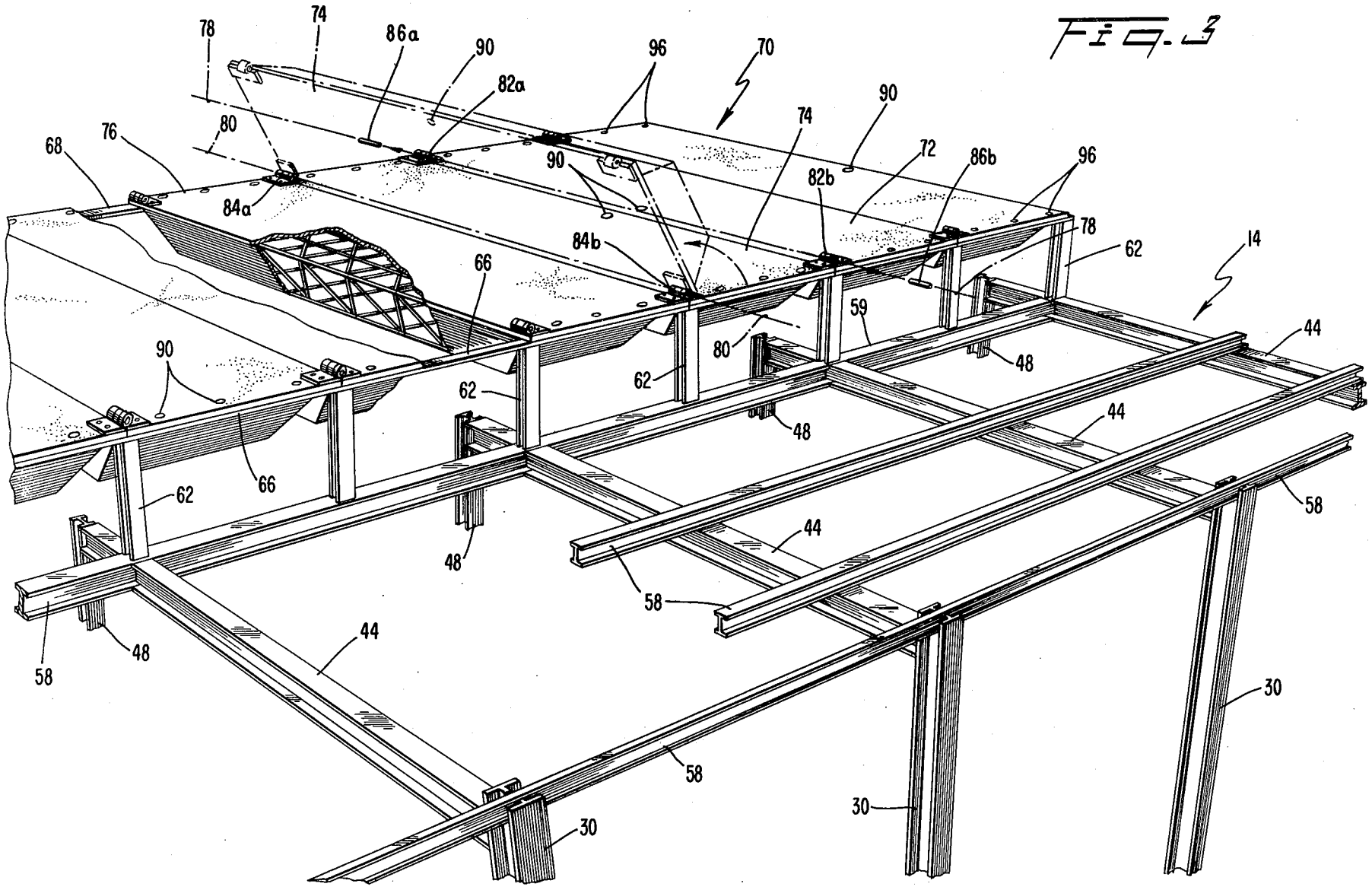
FIG. 3 is an isometric view of the roofing system component of the building according to this invention.

The weight from the top part of building section 14 can be applied directly to the series of transverse members 44, 46 or, as best seen in FIG. 3, ca preferably be applied to two of the series of longitudinal members 58, 59 which connect the transverse members 44, 46 on the respective sides 22 and 24 of the machine 18. In either case, the proportion of the top enclosure weight to be borne by the machine frame sides will vary in the usual manner depending upon the location along the transverse members where the load is applied, the closer to the machine frame the greater the load borne by the machine frame. Although this invention allows the application of the load directly over the machine frame sides, whereby 100% of the load from top part of building section 14 would be carried by the machine frame sides, it is often impractical to do so, in which case the load should be applied as closely adjacent to the machine frame sides as possible, to take fullest advantage of the benefits of this invention.

Longitudinal structural members 58, 59 also serve to provide longitudinal support for the vertical and transverse members and together with these members provides a framework for the partial enclosure of areas 54, 56 by covering with conventional building materials in sheet form, such as corrugated metal panels.

In accordance with this invention, and as seen in FIG. 2, means are provided for forming the top part of building section 14 for enclosing dryer machine 18, the means including building frame superstructure 60 and roof 70. It is the purpose of roof 70 to protect the sheet paper products and internals of the machine 18 from weather damage, and superstructure 60 serves to support roof 70 and to distribute the combined weight from roof 70 and the superstructure itself onto substructure 50, 52.

As embodied herein, superstructure 60 includes a series of secondary vertical members 62, 64 and a pair of secondary longitudinal members 66, 68. The upper ends of the superstructure vertical members 62 and 64 extend upward from substructure 50, 52, terminate at an elevation greater than the highest part of the dryer machine apparatus 18, and are positioned outside of, and closely adjacent to, machine frame sides 22 and 24. The secondary vertical support members 62 and 64 are not positioned directly over the respective machine frame sides but are set outside and adjacent to the respective machine frame sides a distance just sufficient to accommodate the removal of a paper dryer, such as **26*a* or 26*b*, from the top of dryer machine 18. The superstructure vertical members can be attached directly to transverse support members 44 and 46 as shown in FIG. 2 or to another part of substructure 50, 52, preferably longitudinal support members 58, 59 as shown in FIG. 3**.

The superstructure longitudinal members 66 and 68 connect the upper ends of the superstructure vertical support members on the respective sides of the papermaking machine 18 and are also intended to brace the superstructure vertical members as well as to provide support for the roof 70. Conventional industrial sheeting material (not shown) can be used to cover the sides of superstructure 60 in the usual manner.

As embodied herein, and as best seen in FIG. 3, roof 70 is made up from a series of individual sections including sections 72, 74 and 76. The individual sections are placed edge to edge, and each section completely spans the top of drying machinery 18 and is supported by the superstructure longitudinal members 66 and 68. The individual sections are displaceable for allowing access to the top of machine 18 for removal of paper dryers and other maintenance. The dimensions of the individual sections are governed, of course, by the size of the machinery and associated components. In particular, for the drying machinery, the long dimension of the roof section is determined by the distance separating the support members 66 and 68 which distance, in turn, is determined by the length of the cylindrical paper dryers. In the present embodiment, the narrow dimension of the individual roof sections is sufficient to enable the paper dryers to be removed from the top of machine 18 when the overlying roof sections are displaced from their normal rest position. Appropriate rectangular roof section dimensions for a building enclosing conventional paper making machinery are on the order of about 50 feet in the long dimension and 12 feet in the narrow dimension.

In accordance with the invention, each individual roof section, such as section 74, is attached to both immediately adjacent roof sections, such as sections 72 and 76 and also to the superstructure longitudinal support members 66 and 68. A series of bolt assemblies 96 are used to attach each roof section to the secondary longitudinal members 66, 68. The mode of attachment of the adjacent roof sections to each other is such as to allow rotation about one or the other of a pair of axes, such as 78 and 80, associated with each roof section. The axes of rotation are positioned one along each interface between immediately adjacent roof sections, as illustrated with respect to section 74 in FIG. 3.

As herein embodied, pairs of hinge assemblies such as 82*a*, 82*b* and 84*a*, 84*b* are provided to attach adjacent roof sections to one another to permit the required rotation. The pin components of each hinge assembly, such as pins 86*a*, 86*b* are aligned on the respective axis of rotation and are removable to permit an adjacent section, such as section 72, to be detached from section 74, thereby freeing section 74 to be rotated about axis 80, after removal of the respective bolt assemblies 96. Preferably, the pin components also can be removed from adjacent pairs of hinge assemblies, such as 82*a*, 82*b* and 84*a*, 84*b* to permit the total removal of panel 74. In such a case, after removal of the appropriate bolt assemblies, roof sections 72 and 76 can be rotated on the remaining intact hinge assemblies so that additional access to the top of drying machine 18 can be gained. Also, after removal of the appropriate hinge pins and bolt assemblies, the construction of section 74 is such as to allow the section to be temporarily supported by superstructure longitudinal members 66, 68 prior to the total removal.

It is contemplated, nonetheless, that the normal mode of servicing the cylindrical paper dryers of machine 18 will require the removal of only one set of hinge pins and the rotation of one roof section or at most two roof sections after removal of the appropriate bolt assemblies.

Referring now to FIG. 1, removal of a paper dryer such as 26*c* is accomplished with an outside crane means such as mobile crane 88 or by a crane configuration such as shown in my previous U.S. Pat. No. 3,961,712. However, it is economically attractive to periodically rent a mobile crane such as unit 88 to service the drying machine 18 rather than to install as part of the permanent plant equipment an enclosed outside traveling crane system such as shown in my previous patent. Since the removal of a paper dryer occurs relatively infrequently and can usually be accomplished during a scheduled outage of the machinery, the operation can be postponed until favorable weather conditions prevail. As the roof sections, such as section 74, normally are not detached from the building, the need for an enclosed crane system to shield the operation from the wind is eliminated.

Preferably, each roof section, such as section 76 shown in FIG. 3, is composed of modular subsections of a geometric shape for maximizing the ridigity of the section. The individual roof sections must be sufficiently rigid to resist deformation during rotation which can be accomplished by the use of a crane 88, and eye ring fittings 90 are provided at the edges of the roof sections for attaching a crane hook. The strength and rigidity of each individual roof section such as section 76 also must be sufficient to accommodate the weight of an additional roof section, such as section 74, when section 74 is rotated 180° about axis 80 and allowed to come to rest on section 76.

It is presently contemplated that, to erect the building system disclosed in the foregoing description, the following sequence of events and operations will occur. In accordance with the invention, and as best seen in FIG. 2, a series of temporary vertical supports 92 and 94 (shown in dotted lines) are installed adjacent to and along the space to be occupied by the dryer machine frame 20, each temporary support extending upward at least to the level of the part of the machine frame destined to provide support for the building. Temporary supports 92 and 94 should be spaced from the actual position of the machine frame a sufficient distance to allow assembly of the machine frame and associated components.

Further in accordance with the invention, and being the next step in the method of erecting the building of this invention, the remainder of the building frame is erected. That is, vertical members 30 and 32; transverse members 44 and 46; superstructure vertical members 62 and 64; roof 70; longitudinal members 58, 59; and superstructure longitudinal members 66 and 68 are assembled using the temporary supports 92 and 94 to take up the portion of the weight of the top enclosure of the building that will eventually be borne by the machine frame 20, specifically, sides 22 and 24. Upon completion of the erection of the building structural members, a sheet construction material can be used to cover the building frame in a conventional manner to provide a protected environment for the assembly of the dryer machine frame which is the next step in the procedure.

In accordance with the invention, and following the assembly of the dryer machine frame 20, the vertical loads taken up by the temporary supports 92 and 94 are transferred to the machine frame sides 22 and 24, respectively. In the case where the enclosed maintenance space 50 is extended above the top of the machine frame to allow removal of the top felt rool 28*a*, the frame extension members 48 are installed prior to the load transfer from temporary vertical support 92.

In accordance with the invention and being the final step in the erection of the building system of this invention, temporary vertical support members 92 and 94 are removed, permitting the installation of the dryer machine internals and of equipment and structures which are necessary for the eventual operation of the dryer machine 18, such as catwalk 38 and maintenance way 40.

The method of attaching substructure 50, 52 to the dryer machine frame sides 22 and 24 should provide that only the vertical forces due to the weight of superstructure 60 and roof 70 are transmitted. To provide for transverse and longitudinal movement at the points of attachment, conventional slide plate assemblies 98 are shown positioned between transverse member 46 and frame side 24 and also between frame extension 48 and frame side 22. Slide plate assemblies 98 includes top plates 100 fixedly attached to the substructure 50, 52 and bottom plates 104 fixedly attached to the machine frame 20. Bearing plates 102 are positioned between top plates 100 and bottom plates 104. Materials appropriate for bearing plate 102 include polytetrafluoroethylene in sheet form.

Other attachment means allowing relative lateral and longitudinal movement between substructure 50, 52 and frame 20 can, of course, be utilized. It is contemplated that the transverse and longitudinal forces caused by wind loading and differences between the thermal expansion rate in the building frame and the expansion rate of the machine frame will be taken up by vertical support members 30 and 32.

I claim:

1. An industrial building structure for housing a machine and related operating equipment for protection against the weather, the machine having an anchored frame with at least two opposed, weight-bearing sides, the machine requiring operating and maintenance space at the sides of the machine, the structure comprising:

(a) enclosure means for the top of the machine, said top enclosure means including roof means and a building frame superstructure for supporting said roof means, said roof means including means for providing access from outside the building structure to substantially the entire machine top area bounded by the two machine frame sides, said access means permitting maintenance on the machine through said roof means, said building frame superstructure including a pair of longitudinal support members, each of said members being positioned parallel and outwardly adjacent to one of the two opposed machine weight-bearing sides and elevated with respect to the highest point on the machine, and said roof means including a plurality of edge-abutted roof sections each extending between said pair of longitudinal support members and spanning the machine and being removably attached to both immediately adjacent sections and to said longitudinal support members, each section being rotatable about 180° on at least one of a pair of axes lying along the respective abutted edges for exposing the top of the machine, and each of said sections being substantially rigid for minimizing deformation during rotation, each of said sections after rotation being supported solely by the respective one of said adjacent sections; and (b) means providing for support by the machine frame sides of a substantial part of the weight of said top enclosure means, said support means including a building frame substructure for transmitting said substantial part of the weight of said top enclosure means to the machine frame weight-bearing sides and for enclosing each of the two machine frame sides along with the operating and maintenance space associated with each side.

2. The building as in claim 1 wherein said building frame substructure includes:

(a) a plurality of vertical members spaced along and parallel to the machine frame sides and set out from the sides predetermined distances; and (b) a plurality of transverse members extending from said vertical members to the machine frame sides, said transverse members being fixedly attached to said vertical members and to the machine frame sides, and being supported in the vertical direction in part by the machine frame sides and in the other part by said vertical members, said top enclosure means being supported by said substructure at points closely adjacent to the machine frame sides whereby said substantial part of the weight of said top enclosure means is distributed to the machine frame sides, and said substructure defining the associated operating and maintenance space for the machine and providing framework for sealing off said space and the sides of the machine from the weather.

3. The building structure as in claim 2 wherein said building frame substructure further includes a plurality of longitudinal members connecting said transverse members on the respective sides of the machine frame, at least two of said longitudinal members being positioned parallel and closely adjacent to the respective machine frame sides, and wherein said top enclosure means is supported along said at least two longitudinal members.

4. The building as in claim 2 wherein the machine is the dryer section of a paper making apparatus, the dryer having a plurality of cylindrical dryers and felt rolls driven by side-mounted motor means, and said predetermined distances are such as to allow direct in-line placement of the motor drive means adjacent the machine frame sides and to allow flawed paper to be removed from the dryer by a spearing operation carried out through apertures in the machine frame sides.

5. The building as in claim 4 wherein those of said vertical members associated with at least one of the machine frame sides are spaced outwardly from the associated frame side a distance sufficient to accommodate the removal of felt rolls through the respective machine frame side.

6. The building structure as in claim 1 wherein said building frame superstructure includes:

a plurality of superstructure vertical members for distributing the weight of said roof means to said top enclosure support means, said superstructure vertical members extending above the highest part of the machine frame and positioned outside of, and closely adjacent to, the machine frame sides, and said pair of superstructure longitudinal members connecting each of said superstructure vertical members on the respective sides of the machine frame, said superstructure longitudinal members being positioned at the upper ends of said superstructure vertical members.

7. The building structure as in claim 1 wherein said sections are attached to said adjacent sections by pluralities of pairs of hinge assemblies having removable pins, the pins of each of said pairs of hinge assemblies lying on the respective one of said axes of rotation, and wherein said sections are attached to said longitudinal support members by a plurality of removable bolt means.

8. The building structure as in claim 7 wherein the pins are removable from adjacent pairs of hinge assemblies and the roof section therebetween is temporarily supportable on said longitudinal members for subsequent total removal of said temporarily supported roof section upon removal of said bolt means, additional access to the top of the machine being gained by the total removal of said temporarily supported section.

9. The building structure as in claim 1 wherein said machine is the dryer section of a paper making apparatus, and the dimensions of said roof sections are sized to permit the cylindrical paper dryers to be removed from the top of the machine.

10. The building structure as in claim 9 wherein said roof sections are substantially rectangular having dimensions of about 50 feet along the abutted edges and about 12 feet along said longitudinal support members.

11. The building structure as in claim 1 wherein each roof section is made up of modular subsections of a geometric shape for increased rigidity and decreased weight.

* * * * *